US007128368B2

(12) United States Patent
Sligh

(10) Patent No.: US 7,128,368 B2
(45) Date of Patent: Oct. 31, 2006

(54) DRUMMER SEATING SYSTEM

(76) Inventor: Vaughn Monroe Sligh, 2813 Westfield Ave., Baltimore, MD (US) 21214-1234

( * ) Notice: Subject to any disclaimer, the term of this patent is extended or adjusted under 35 U.S.C. 154(b) by 492 days.

(21) Appl. No.: 10/629,334

(22) Filed: Jul. 29, 2003

(65) Prior Publication Data

US 2004/0100132 A1 May 27, 2004

Related U.S. Application Data

(60) Provisional application No. 60/399,466, filed on Jul. 29, 2002.

(51) Int. Cl.
*A47C 7/62* (2006.01)

(52) U.S. Cl. ..... 297/186; 297/344.21; 84/421

(58) Field of Classification Search ..... 297/185, 297/186, 344.21; 87/421
See application file for complete search history.

(56) References Cited

U.S. PATENT DOCUMENTS

| | | | | |
|---|---|---|---|---|
| 3,193,325 | A * | 7/1965 | Wenger | 297/186 |
| 3,259,428 | A * | 7/1966 | Wenger et al. | 297/186 |
| 5,692,800 | A * | 12/1997 | Perin | 297/185 |
| 5,744,738 | A | 4/1998 | Gatzen | |
| 6,030,045 | A | 2/2000 | Hoshino | |
| 6,073,999 | A | 6/2000 | Crane | |

* cited by examiner

*Primary Examiner*—Anthony D. Barfield
(74) *Attorney, Agent, or Firm*—Ober/Kaler

(57) ABSTRACT

A drummer seating system inclusive of a drum seat and one or more drum holders attached to the seat which lift their respective drums off the floor and position them in front of the percussionist. The percussionist remains free to rotate the drum seat clockwise or counter-clockwise 360 degrees while the drum(s) remain in a normal playing position.

4 Claims, 9 Drawing Sheets

DRUMMER SEATING SYSTEM

CROSS-REFERENCE TO RELATED APPLICATIONS

The present application derives priority from U.S. Provisional Patent Application No. 60/399,466 filed: Jul. 29, 2002.

BACKGROUND OF THE INVENTION

1. Field of the Invention

This invention relates to instrument racks and, in particular, to a drummer seating system inclusive of a drum seat and one or more drum holders which can be attached thereto to lift the drums off the floor and position them in front of the percussionist while still allowing the percussionist to rotate the drum seat with the drum(s) remaining in position.

2. Description of the Background

Drummers typically play their instruments while sitting on a stool. Each different drum and accessory is separately mounted on the stage as a stand alone device. This conventional drum arrangement has been less than satisfactory in a number of respects.

In a normal drum set environment, the drummer sits on a stationery seat straddling a snare drum mounted on a stationary stand supported by the floor. The normal drum setup for a right handed drummer will have the left foot playing the hi-hat pedal, and the right foot playing the bass drum pedal. There is normally at least one tom-tom mounted over the bass drum and another to his right mounted to legs and supported by the floor. This simple arrangement does not pose a large problem for the drummer utilizing the traditional method of supporting the snare drum because all drums and pedals are within comfortable proximity.

However, in larger drum setups, having the snare drum on a stationary holder supported by the floor can impede the drummer's ability to comfortably access all drums using both hands and both feet. For example, in a double-bass drum setup the left foot would control the hi-hat and one bass drum (pedals to the left of the snare drum), and the right foot would control the other bass drum only (pedal to the right of the snare drum). As bass drum and hi-hat pedals are added to the drum kit, it becomes very limiting as to which foot can access which pedals. If a third bass drum is added, it will have to be placed either to the right or the left of the snare drum, and can be accessed by only the right or left foot respectively. Also, as more tom-toms are added to the kit, the drummer has to twist his torso to access the toms with the snare stationery between his legs. This twisting will cause more rapid fatigue to a drummer while playing a larger drum setup.

Similarly, a percussionist in a normal orchestra environment stands behind a snare drum mounted on a stationary stand supported by the floor. This results in fatigue for the percussionist after hours of standing and playing during an orchestra performance.

There has long been a need for a versatile seat for use by musicians while playing their instruments which eliminates fatigue by making the components more accessible. There have also been a few prior efforts to improve the situation.

For example, U.S. Pat. No. 6,073,999 to Crane shows a drum stand for an African drum including a rigid frame that is connected to a seat. The frame includes at least two legs and an opening to accept the drum wherein the drum rests in the frame and wherein the drum is suspended above the ground whereby an arcuate portion of the lower opening of the drum contacts the ground.

U.S. Pat. No. 6,030,045 to Hoshino shows a holding structure which supports a seat of a drum chair, in order to permit the seat to be rotated and preventing its undesired rotation, without loosening of the seat.

U.S. Pat. No. 5,744,738 issued to Gatzen shows a rigid frame for musical drums and cymbals as well as a seat for a drummer. The seat is adjustable and accommodates the drummer in a recumbent position.

Unfortunately, none of the foregoing or any other known references provide a drum seat and support system in which the seat can be rotated, and each of the attached drum supports can be rotated uniformly with the drum seat in either direction 360 degrees. A drum setup of this type would allow access to all bass drum and hi-hat pedals, by either foot, and all tom-toms, hi-hats, cymbals, etc., by either hand, while maintaining the snare drum in a comfortable playing position.

SUMMARY OF THE INVENTION

It is therefore an object of the present invention to provide a drum seat system inclusive of one or more drum holders which can be attached thereto to lift the drums off the floor and position them in front of the percussionist while seated.

It is another object to provide a drum seat system as described above which allows the percussionist to rotate the drum seat clockwise or counter-clockwise 360 degrees while the drum(s) remain in a normal playing position. This will permit the percussionist to sit while playing during an orchestra performance, thus eliminating the fatigue developed from standing during long performances.

It is another object to provide a drum seat system as described above which allows each of the attached drum supports to be rotated uniformly with the drum seat in either direction 360 degrees.

These and other objects are accomplished by the provision of a drummer seating system including a drum seat with a stool rotatably mounted on a seat post, and a plurality of stand-up legs (such as a tripod) mounted on the other end of the seat post. One or more percussion components are adjustably attached to the drum seat post by drum supporting assemblies. Each drum supporting assembly comprises a screw clamp attached to the seat post and both pivotable and vertically adjustable there along. The screw clamp include a block with a hole defined therein. A supporting arm is insertable in the hole of the screw clamp. In addition, a screw clamp junction is removably attached to the protruding end of the supporting arm and is likewise both pivotable and adjustable there along. The screw clamp junction includes a first hole for receiving the supporting arm, and a second hole angularly offset from said first hole for receiving a support post. The support post is insertable in the second hole of the screw clamp junction, and an adjustment joint is seated on the support post for mounting a percussion component thereon at a selectable angular tilt relative to the support post. The resulting drummer seating system provides a rotatable drum seat and allows the attachment of one or more percussion components to the seat so as to lift them off the floor and position them in front of the percussionist. The percussionist remains free to rotate the drum seat clockwise or counter-clockwise 360 degrees while the drum(s) remain in a normal playing position.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
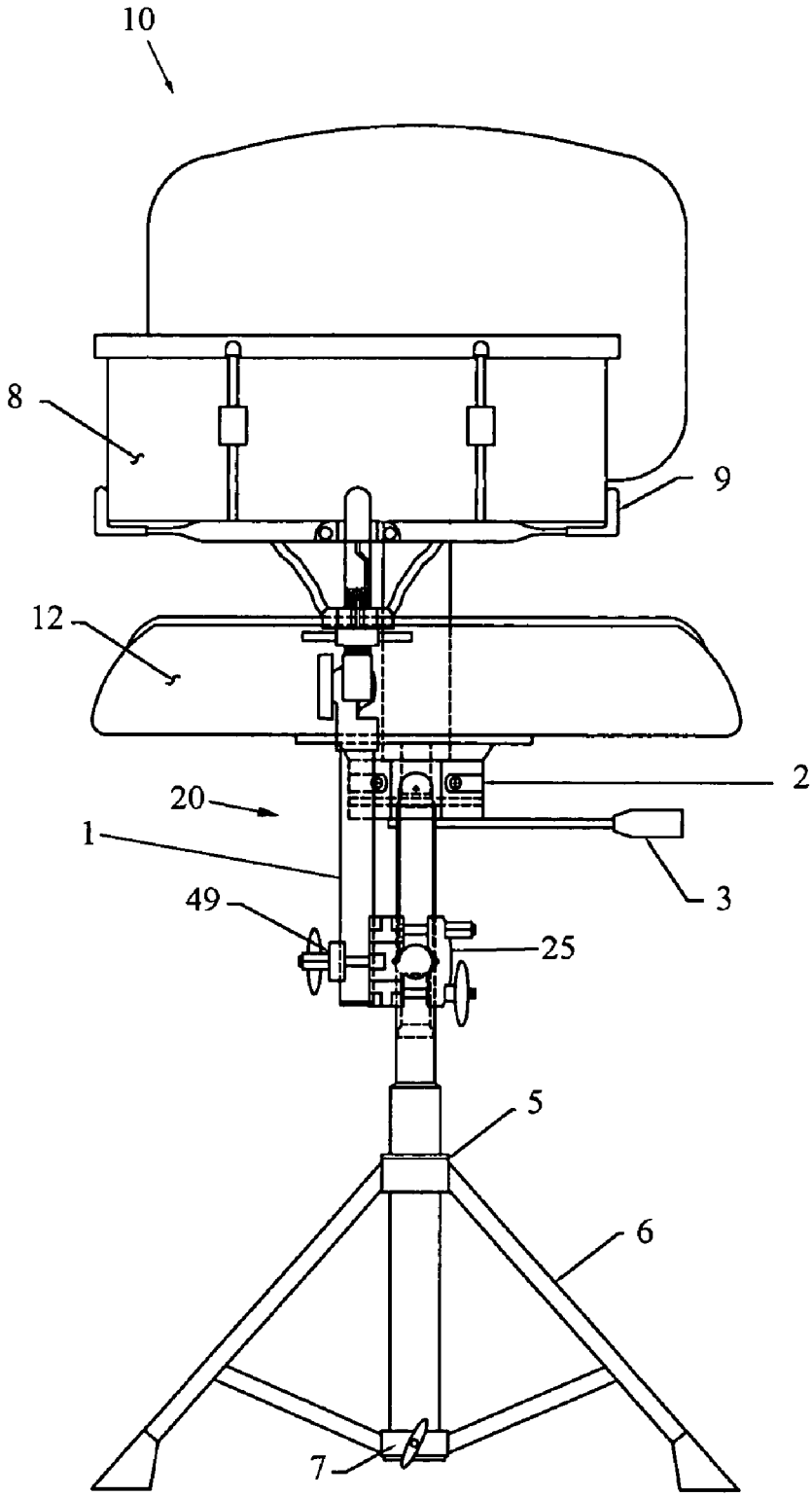
FIG. 1 is a front view.
Figure 2:
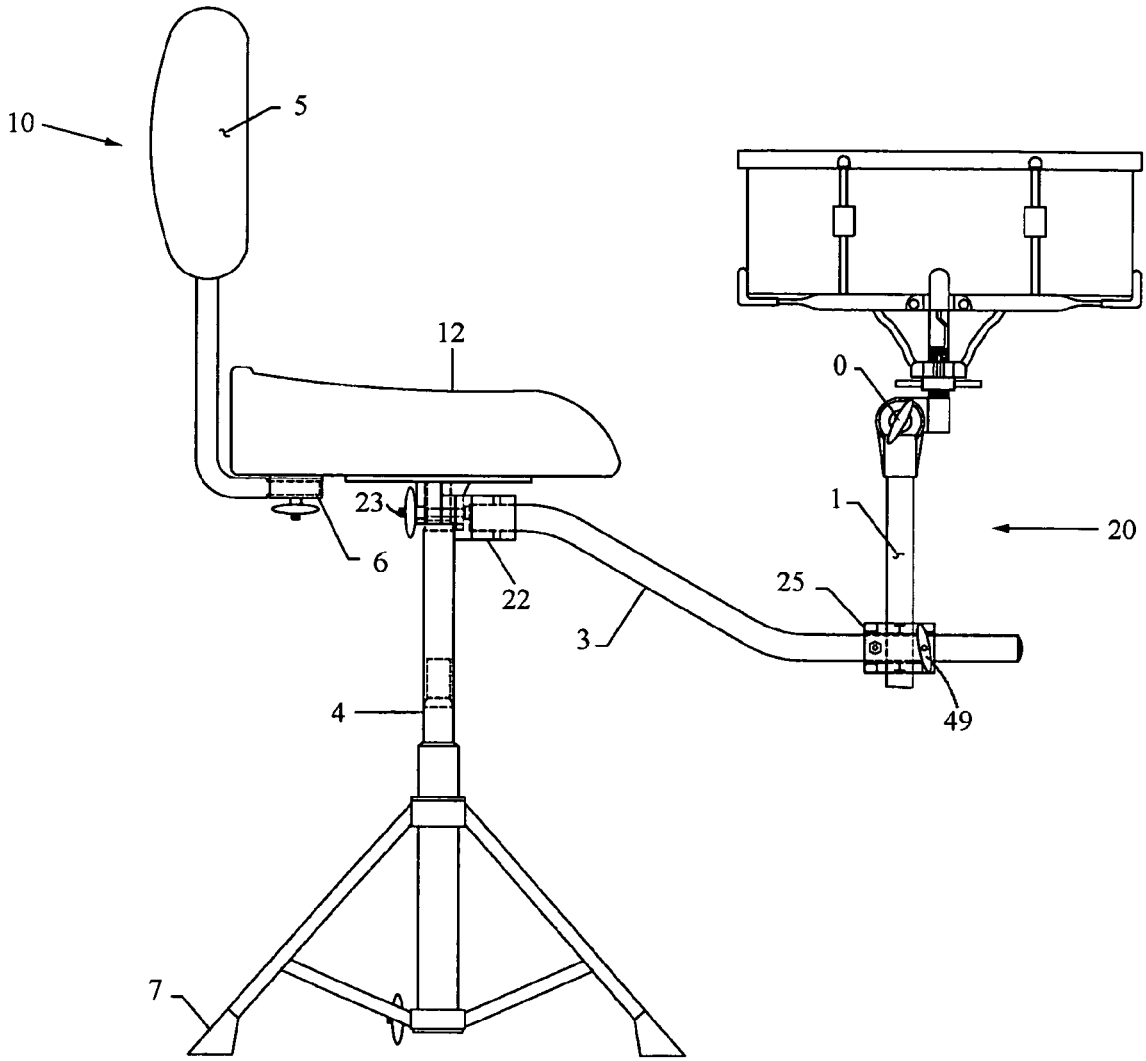
FIG. 2 is a side view, respectively, of a drum-seat/drum-holder system according to the present invention.

FIG. 1 is a front view, and FIG. 2 is a side view, respectively, of a drum-seat/drum-holder system according to the present invention. The drum-seat/drum-holder system shown in FIGS. 1 and 2 generally includes a drum seat 10 inclusive of an elevated rear back support 5 removably secured to the underside of a swivel seat pad 12 via a screw clamp 6. The drum seat 10 is rotatably supported on a central post 4 which is held erect by folding tripod or quadrapod legs legs 7.

The embodiment shown in FIG. 1 is equipped with a single support assembly 20 shown supporting a standard snare drum. Support assembly 20 is pivotally attached to the central post 4 of seat 10 via a mounting block 22. An angled supporting arm 3 extends outward from mounting block 22 away from post 4. A vertical drum support post 1 is adjustably attached along the distal end of the angled supporting arm 3 via a screw clamp junction 25. Screw clamp junction 25 is a commercially available 90 degree clamp which allows the drums to be connected to the drum seat support arm 3. The snare drum itself is mounted atop the vertical support post 1 by a toothed locking joint 0 which allow adjustment of the tilt angle of the snare drum. The foregoing configuration lifts the snare drum off the floor, allowing it to rotate uniformly with the drum seat 10 in either direction 360 degrees. This allows easy access to all stationery bass drums and hi-hat pedals, by either foot, and all tom-toms, hi-hats, cymbals, etc., by either hand, while maintaining the snare drum in a comfortable playing position. Moreover, the position of the snare can be adjusted along any axis, and the tilt angle can be adjusted as well.

Figure 5:
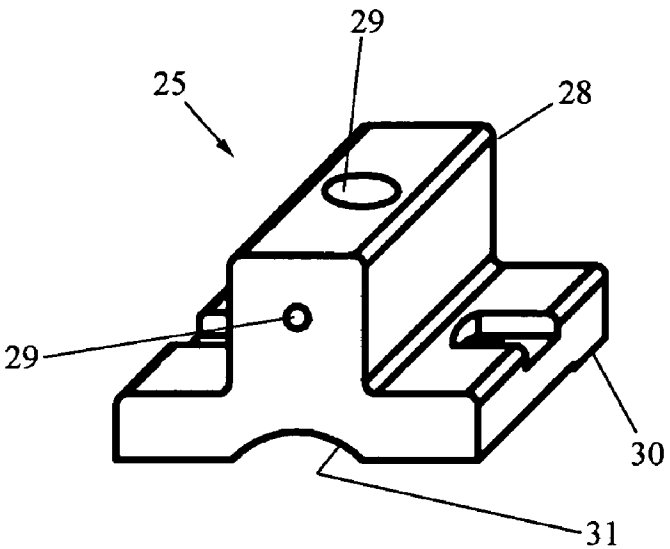
FIGS. 3–5 are a top view, side cross-section, and perspective view, respectively, of a half-section A of a mounting block 22.
Figure 3:
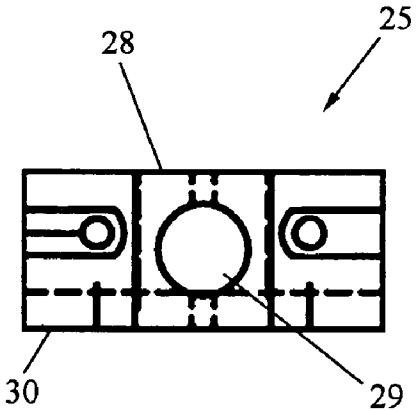
Figure 4:
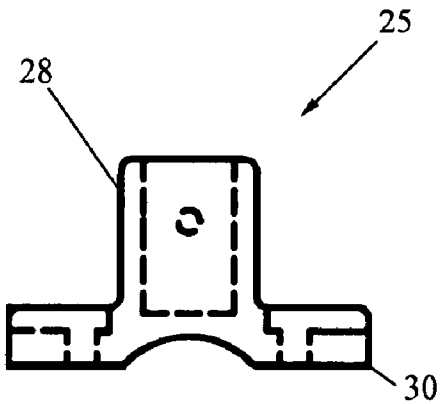

FIGS. 3–5 are a top view, side cross-section, and perspective view, respectively, of a half-section A of mounting block 22. The half-section A of the mounting block 22 generally comprises a raised bar 28 integrally joined to a base 30. Base 30 is defined by a lengthwise arcuate recess 31 conforming to the curve of seat post 4 and for seating the seat post 4 therein. The raised bar 28 is also defined by a cylindrical hole 29 for insertion of angled supporting arm 3. The supporting arm 3 may be secured to the bar 28 by inserting a locking pin through the smaller hole 29 at one end of the block (see FIG. 5), passing through the tubing of supporting arm 3 and flush with a coaxial hole at other end of the block. The raised bar 28 also has two mounting holes to accept two machine screws, and these are preferably slotted as shown to seat two hex bolts which prevent the screws from turning when securing the bar 28 to the drum seat post 4. The entire seat mounting assembly 2 includes half section A plus a mating half-section B (not shown) which is substantially identical except that no raised bar 28 is necessary. The two half sections A and B are sandwiched together about the seat post 4 and are tightened together by a screw-knob 23 as seen in FIG. 1. The two half sections A and B may be formed of machined aluminum block, molded carbon-reinforced plastic, or other strong material.

Figure 6:
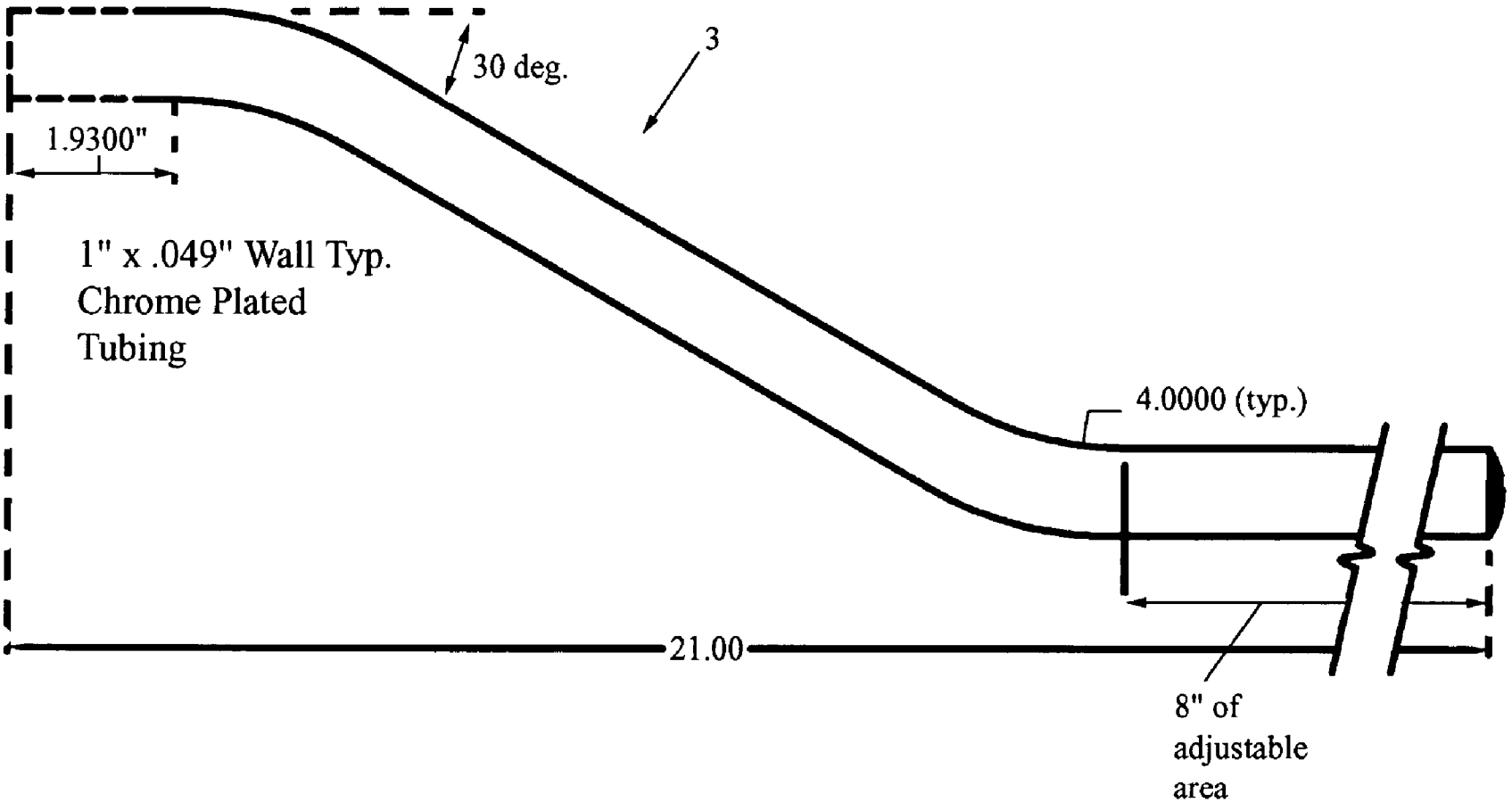
FIG. 6 is a side view of the angled supporting arm 3 which is inserted at one end into the mounting block 22 of FIG. 1.

FIG. 6 is a side view of the angled supporting arm 3 which is inserted at one end into the mounting block 22 of FIG. 1. The screw clamp junction 25 is inserted onto the other end of supporting arm 3. Angled supporting arm 3 may be a section of hollow steel tubing angled as shown.

Referring back to FIGS. 1 and 2, the support post 1 may be a short section of steel tubing, and the toothed locking joint 0 which is mounted thereon is a conventional adjustment joint to allow adjustment of the tilt angle of the snare drum. These adjustment joints comprise two mating half sections with mesh facing teeth that can be locked together by a tightening screw, or loosened for relative adjustment. Such joints are commonly used for microphones booms and the like.

Assembly of the foregoing components in the configuration shown in FIGS. 1 and 2 allows the snare drum to rotate uniformly with the drum seat 10 in either direction 360 degrees, and the position and/or tilt can be adjusted along any axis for maximum comfort.

In addition to the foregoing, the mounting block 22 can be modified to accept multiple support assemblies 20 for supporting multiple drums as needed. For example, an auxiliary snare drum (or other percussion instrument) and a normal floor tom-tom (or other percussion instrument) can be mounted on additional support assemblies 20 on either side of the seat and main snare drum.

Figure 7:
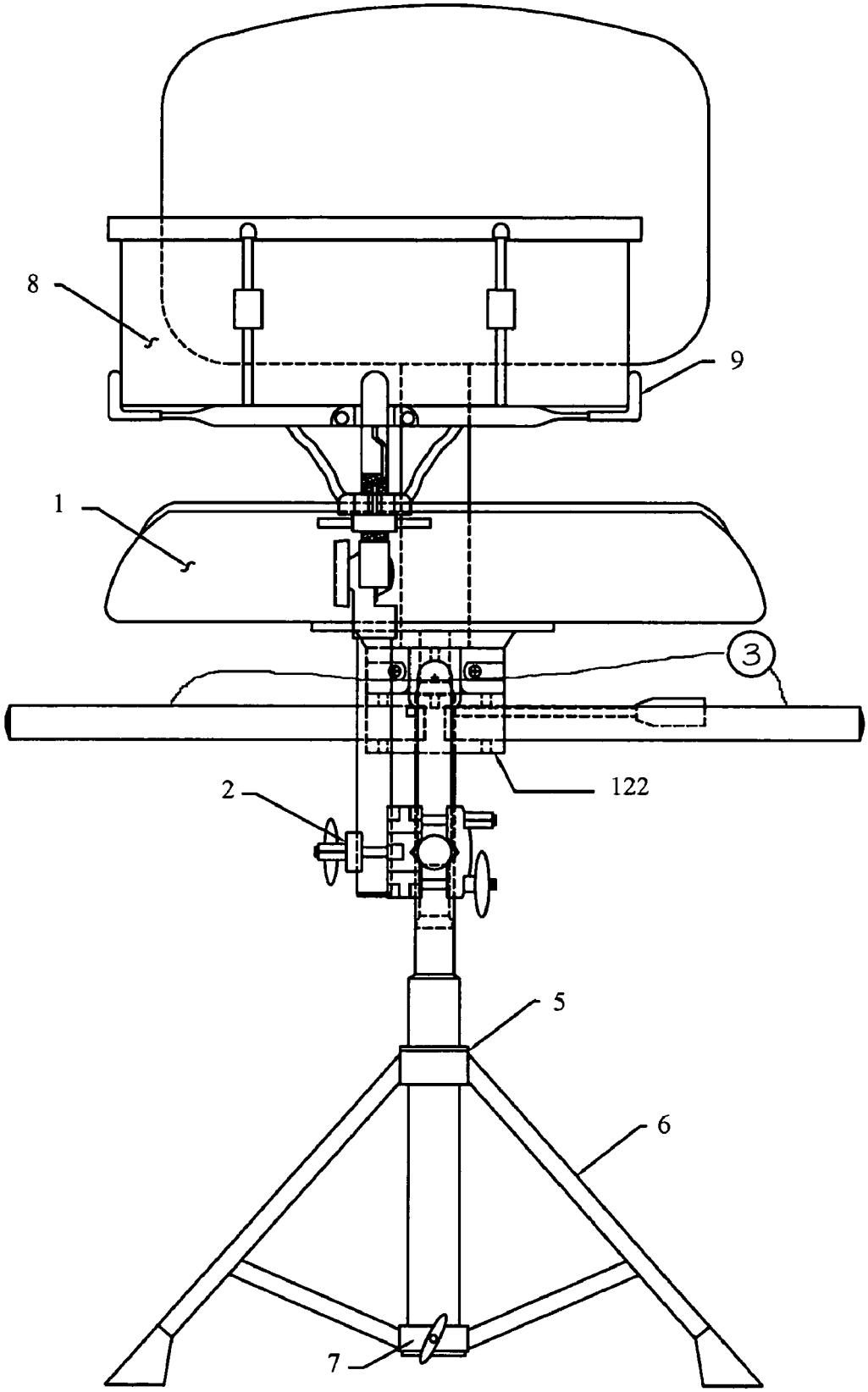
FIG. 7 is a front view.
Figure 8:
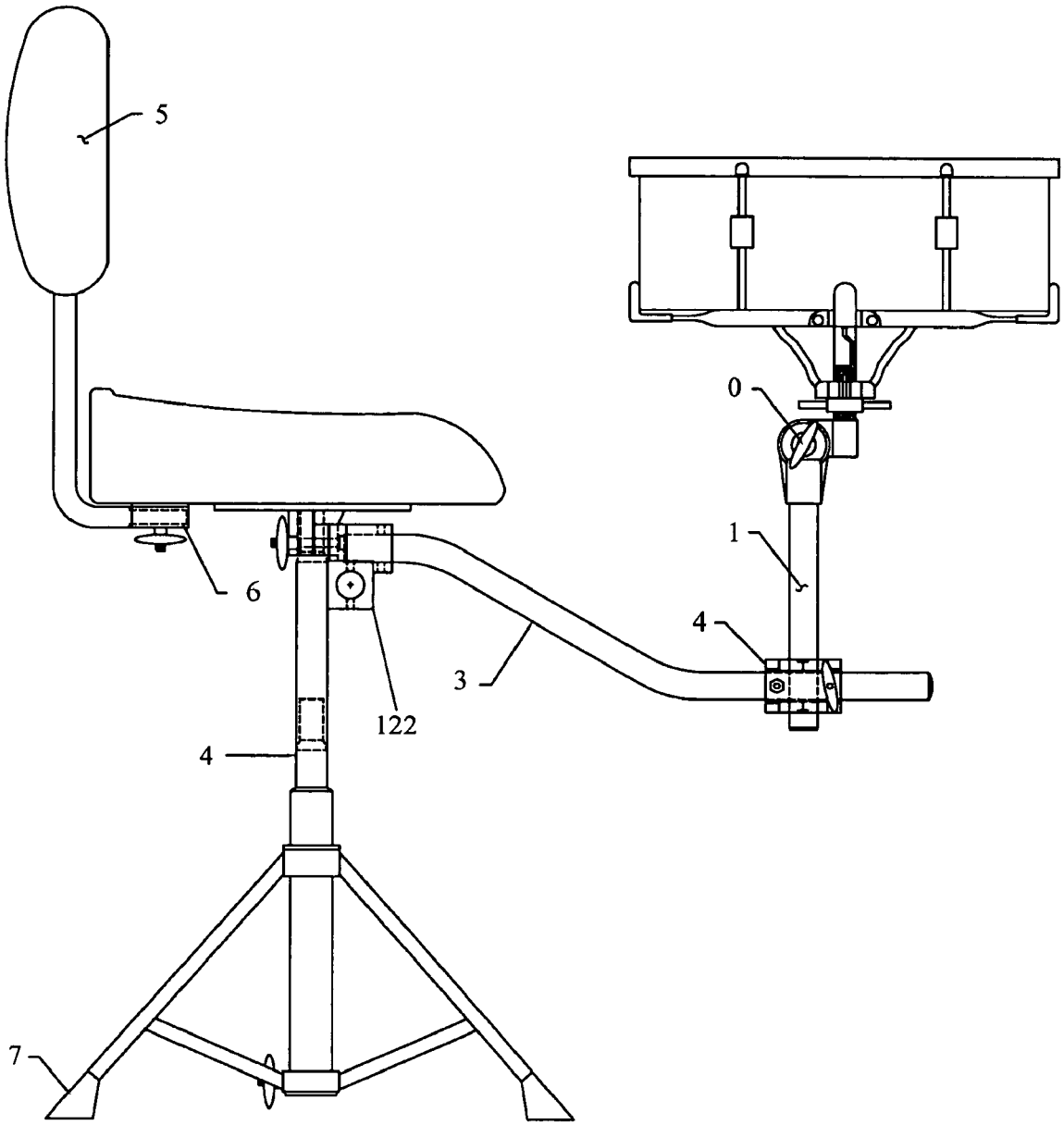
FIG. 8 is a side view, respectively, of a multiple drum-seat/drum-holder system according to an alternative embodiment of the present invention.

FIG. 7 is a front view, and FIG. 8 is a side view, respectively, of a drum-seat/drum-holder system according to an alternative embodiment of the present invention which employs a modified drum seat mounting block 122 to hold multiple support assemblies 20 for an auxiliary snare drum (or other percussion instrument) as well as a normal floor tom-tom.

Figure 11:
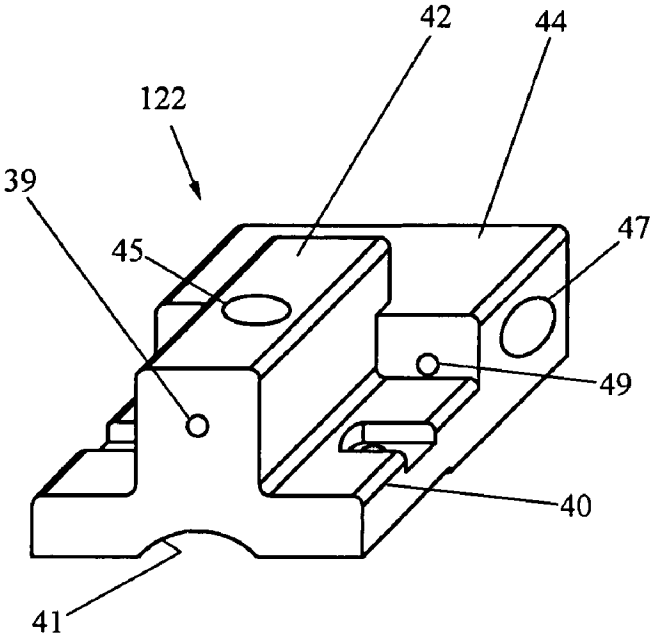
FIGS. 9–11 are a top view, side cross-section, and perspective view, respectively, of a half-section A of the screw clamp junction 25.
Figure 9:
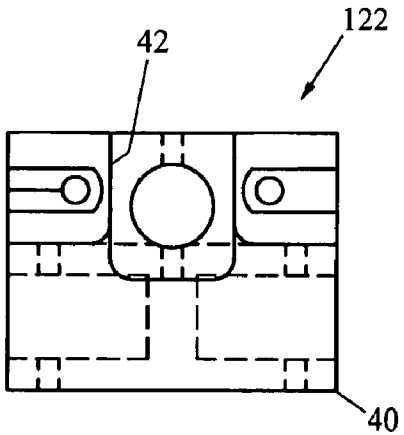
Figure 10:
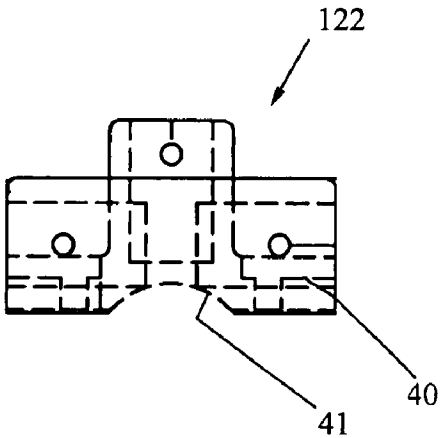

FIGS. 9–11 are a top view, side cross-section, and perspective view, respectively, of a half-section of an alternative embodiment of a drum seat mounting block 122 for supporting three drums. The half-section of the drum seat mounting block 122 generally comprises two orthogonal raised bars 42, 44 integrally joined to a base 40. Base 40 is defined by a lengthwise arcuate recess 41 conforming to the curve of the seat post 4. The raised mounting blocks 42, 44 are each defined by a cylindrical holes 45, 47, respectively, for insertion of three support arms 3 therein (two diametric arms 3 in hole 47 and one perpendicular arm in hole 45). As described previously, the supporting arms 3 may be secured to the block 122 by insertion of locking pins through the smaller holes 39, 49 (see FIG. 11), the locking pins passing through the tubing and flush with coaxial holes at other ends of the block. The entire drum seat mounting block 122 includes two mating half sections: one is not shown but is substantially identical except that no raised mounting blocks 42, 44 are necessary. The two half sections are sandwiched together about the drum seat post 4 and are tightened together by a screw-knob 23 as seen in FIG. 1. The two half sections may be formed of machined aluminum block, molded carbon-reinforced plastic, or other strong material. This alternative multiple-drum supporting embodiment allows easy access to all foot pedals by both feet, and all tom-toms and etc. by both hands, meanwhile maintaining all three drums in a comfortable playing position as the drummer transitions around the drum kit.

Figure 12:
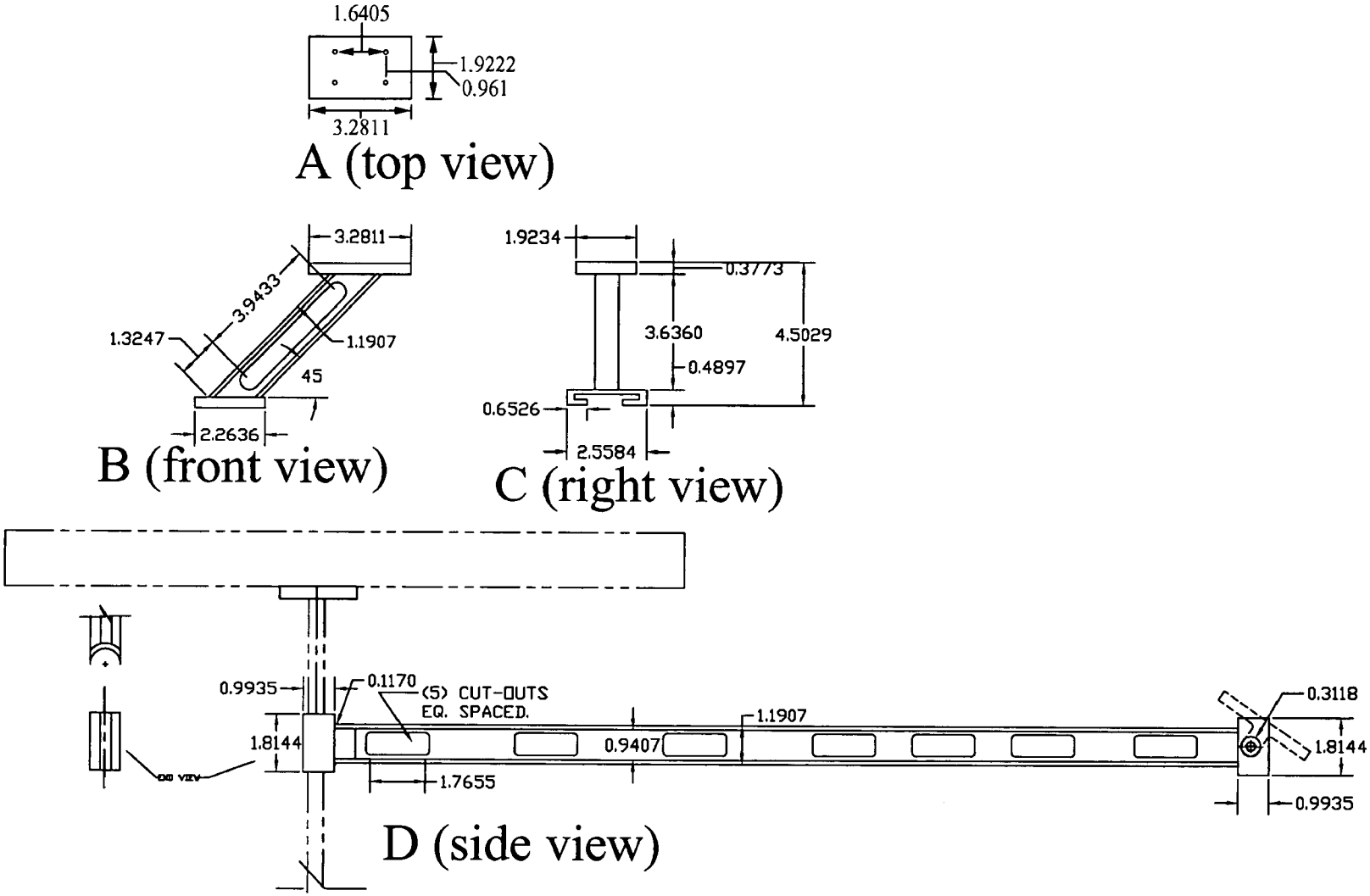
FIG. 12 is a composite exploded side view.
Figure 13:
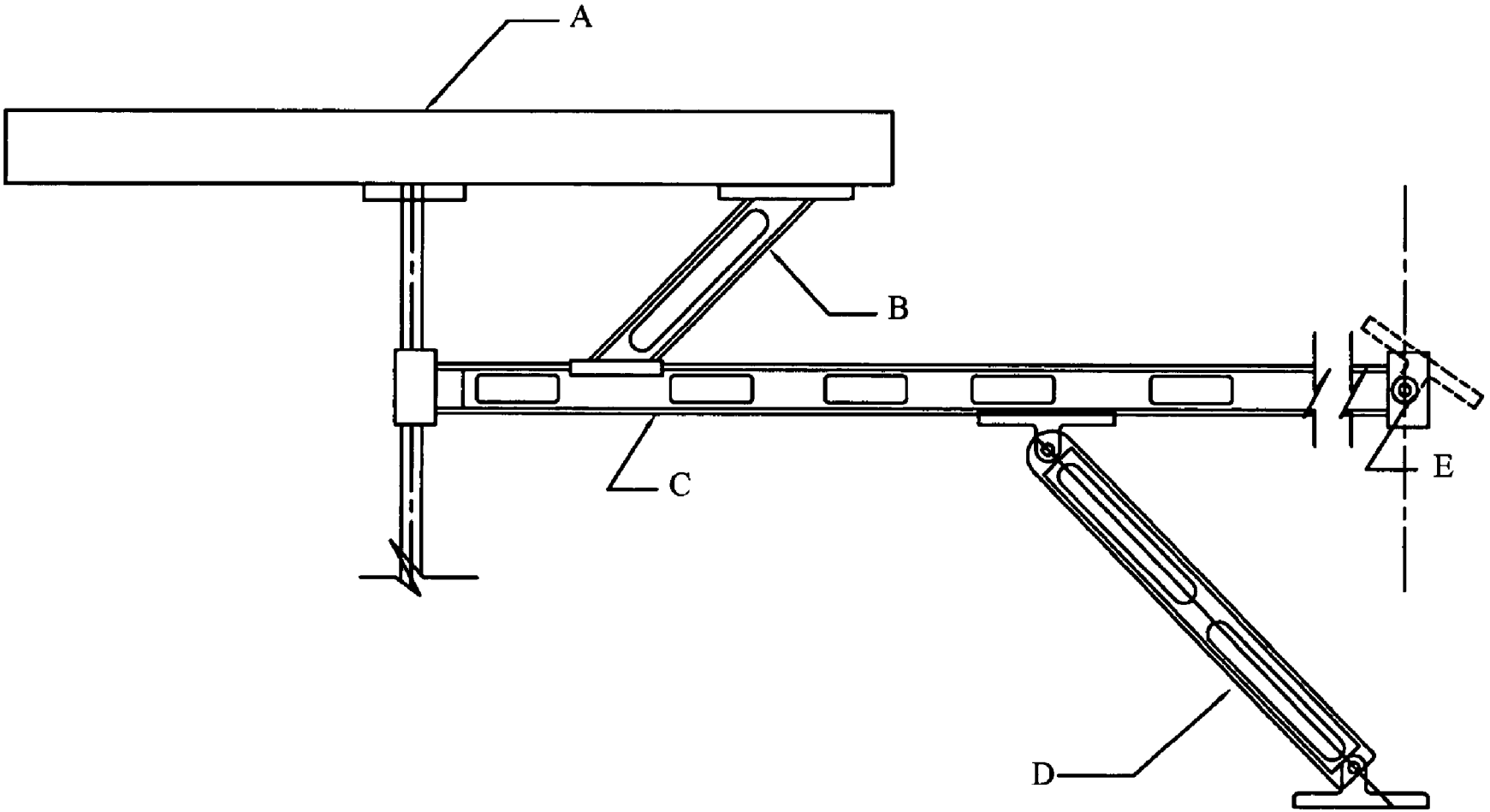
FIG. 13 is an assembled side view, respectively, of a drum-seat/drum-holder system according to yet another alternative embodiment of the present invention.

FIG. 12 is a composite exploded side view, and FIG. 13 is an assembled side view, respectively, of a drum seat/holder with a collapsible support leg assembly attached to allow for added stability in the case where tripod bases are utilized. The embodiment shown utilizes a four-leg base inclusive of a guide rail C formed with an I-beam cross-section, sliding support arm B with a slotted runner for slidable mounting along the upper length of guide rail C, and a pivoting leg D attached along the guide rail C for providing ground support. The pivoting leg D is pivotally attached to another slotted runner for slidable mounting along the upper length of guide rail C, and thus pivoting leg D slides along the guide rail C and pivots downward for providing additional ground support. The pivoting leg D is equipped with a pivot-foot for a firm footing. The sliding support arm B is adjusted as desired underneath the platform A as shown to provide an additional measure of support.

It is also noteworthy that the pivoting leg D in this alternative embodiment can serve to lock the seat A from rotating by dropping between the double brace of one of the support legs such that the drum is positioned directly over one of the support legs, thereby preventing the seat A from tilting forward when no one is seated.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth in the appended claims:

I claim:

1. A drummer seating system, comprising:

a drum seat including a stool rotatably mounted on one end of a seat post, and a plurality of stand-up legs mounted on another end of said seat post;

a drum seat mounting block removably attached to said seat post, said drum seat mounting block including a hole therein;

a supporting arm insertable in the hole of said drum seat mounting block;

a screw clamp junction removably attached to said supporting arm, said screw clamp junction including a first hole for receiving said supporting arm, and a second hole angularly offset from said first hole;

a support post insertable in the second hole of the screw clamp junction; and an adjustment joint seated on said support post for mounting a percussion component thereon at a selectable angular tilt relative to said support post.

2. The drummer seating system according to claim 1, wherein said drum seat mounting block further comprises two clamping half-sections removably attachable to said seat post, one of said half sections having a hole therein.

3. The drummer seating system according to claim 1, wherein said drum seat mounting block further comprises two clamping half-sections removably attachable to said seat post, one of said half sections having a raised reinforcing bar with a hole there through.

4. A drummer seating system, comprising:

a drum seat including a stool rotatably mounted on one end of a seat post, and a plurality of stand-up legs mounted on another end of said seat post;

a drum seat mounting block removably attached to said seat post, said drum seat mounting block including a plurality of axial holes therein;

a plurality of supporting arms each insertable into one of the holes of said drum seat mounting block;

a plurality of screw clamp junctions each removably attached to one of said supporting arm, said screw clamp junction including a first hole for receiving said supporting arm, and a second hole angularly offset from said first hole;

a plurality of support posts each insertable in the second hole of a screw clamp junction; and a plurality of adjustment joints each seated on a respective support post for mounting a percussion component thereon at a selectable angular tilt relative to said support post.

* * * * *